US007959331B2

(12) United States Patent
Ho

(10) Patent No.: US 7,959,331 B2
(45) Date of Patent: Jun. 14, 2011

(54) LAMP HOUSING FOR HIGH-POWER LED STREET LAMP

(76) Inventor: Yen-Wei Ho, Taichung (TW)

( * ) Notice: Subject to any disclaimer, the term of this patent is extended or adjusted under 35 U.S.C. 154(b) by 117 days.

(21) Appl. No.: 12/230,637

(22) Filed: Sep. 3, 2008

(65) Prior Publication Data

US 2009/0262543 A1 Oct. 22, 2009

(30) Foreign Application Priority Data

Apr. 18, 2008 (TW) ..... 97206719 U

(51) Int. Cl.
*F21V 29/00* (2006.01)
*F21V 21/116* (2006.01)

(52) U.S. Cl. ..... 362/373; 362/249.02; 362/311.02

(58) Field of Classification Search ..... 362/231, 362/240, 246, 249.02, 311.02, 217.05–217.07, 362/311.05, 414, 443, 145, 194, 373
See application file for complete search history.

(56) References Cited

U.S. PATENT DOCUMENTS 2,972,675 A * 2/1961 Schiffer ..... 362/396
4,669,033 A * 5/1987 Lee ..... 362/319
4,719,546 A * 1/1988 Spitz ..... 362/260
4,729,076 A * 3/1988 Masami et al. ..... 362/235
6,641,284 B2 * 11/2003 Stopa et al. ..... 362/240
D545,485 S * 6/2007 Hargreaves ..... D26/118
7,278,761 B2 * 10/2007 Kuan ..... 362/294
7,338,186 B1 * 3/2008 Wu et al. ..... 362/294
7,488,093 B1 * 2/2009 Huang et al. ..... 362/294
7,717,587 B2 * 5/2010 Lin et al. ..... 362/249.06
2002/0080575 A1 * 6/2002 Nam et al. ..... 361/686
2003/0214803 A1 * 11/2003 Ono et al. ..... 362/1
2004/0174651 A1 * 9/2004 Aisenbrey ..... 361/103
2004/0213016 A1 * 10/2004 Rice ..... 362/547
2006/0187660 A1 * 8/2006 Liu ..... 362/294
2006/0262571 A1 * 11/2006 Chen ..... 362/632
2007/0081339 A1 * 4/2007 Chung et al. ..... 362/294
2008/0298069 A1 * 12/2008 Chu ..... 362/294
2009/0237931 A1 * 9/2009 Liu et al. ..... 362/240
2009/0244895 A1 * 10/2009 Chen ..... 362/249.02
2009/0268463 A1 * 10/2009 Huang et al. ..... 362/249.02

* cited by examiner

*Primary Examiner* — Ismael Negron
(74) *Attorney, Agent, or Firm* — Raymond y. Chan; David and Raymond Patent Firm

(57) ABSTRACT

A lamp housing for a high-power LED street lamp has symmetrical rectangular planes formed at each side of a centerline of a back wall thereof. The included angle intersected with direction lines normal to the two outermost symmetrically rectangular planes is between 60~140 degrees. The rectangular planes are adapted for containing high-power LED modules to emit light with various interlacing included angles and at interlacing locations.

1 Claim, 13 Drawing Sheets

LAMP HOUSING FOR HIGH-POWER LED STREET LAMP

FIELD ON THE INVENTION

The present invention relates to a lamp housing for a high power LED (light emitting diode) street lamp, which is capable of installing multiple LED light source modules to produce a greater and more effective illumination field, to enhance the illumination intensity and uniformity in the effective illumination field, and to increase optical angles with high brightness.

BACKGROUND OF THE INVENTION

In recent years, since the brightness of LEDs is continuously developed and improved, the application scope of LEDs is greatly expanded. The grouped LEDs are sufficient to produce an illumination efficiency with great power by incorporating an array technique with the optical angle design.

For example, a conventional large power LED street lamp is disclosed in a China patent application number, 200710043662.7, which includes LED light source modules installed on a matrix set in the large power LED street lamp adjacently protruding upwards to the light emitting direction of the lamp and provided with several load planes loading the modules. The end surfaces of the load planes are symmetric to the center of the matrix. The included angle of two first load planes provided closely to the matrix end plane center and the central plane of the matrix plane is 76-86 deg. The angle formed by the second plane close to the first and the matrix end plane is 49-59 deg. The angle formed by a third load plane close to the second and the center of the end plane of the matrix is 37-47 deg.

The foregoing matrix of such structure arranges convex sections of load planes in step manner. The design can provide a radiation form of light emitting direction of the LED light source modules to achieve an enhancement of the illumination field.

However, it is doubted that whether the light distribution design of the matrix provided for installing the LED light source modules, such as several load planes corresponding to the matrix and several load planes corresponding to each other, can achieve the optimum light distribution. The reason is that the matrix divides the protruded load plane into six load planes within a range in which the maximum total included angle of light emitting of the two load planes is around 120 degrees based upon the symmetrical manner at the center. Consequently, the included angles of adjacent load planes are too big that easily causes fewer field interlaced due to the light emitting direction of the LED light source modules installed on each load plane, resulting in light shape problem and non-uniform brightness in the illumination field.

Another LED street lamp device disclosed in a Taiwan patent number M32543 comprises a lamp holder having an inwardly recessed lamp chamber, wherein the front and rear ends of a long edge are inwardly bent to form an oblique. A plurality of lamp sets, each of which has a plurality of light emitting diodes, are arranged along a short edge of the lamp chamber to form three rows, wherein the lamp sets at the left and right rows are inwardly slanted along an inner edge surface of the lamp chamber, and the lamp set disposed at the same row is inwardly slanted as well.

The foregoing Taiwan patent is to design the lamp holder to form the lamp chamber. The lamp chamber is inwardly slanted at the front and rear ends of the long edge and both sides of the short edge, wherein the short edge in the lamp chamber is restricted to install three rows of lamp sets. Each row of lamp sets is composed of a plurality of single lamp set.

The foregoing structure utilizes the lamp chamber disposed in the lamp holder so that the three rows of the lamp sets installed in the lamp chamber form a lamp set at the middle row with respect to the center position of the lamp chamber. The symmetrical lamp sets have oblique angles at both sides to provide a light source illumination. The foregoing optical design can effectively improve the illumination effects of its illumination field although the overlapping effect is generated by the light emitting direction of the three rows of lamps sets. However, the lamp housing still has the following shortcomings.

Among the three rows of lamp sets installed to the lamp holder, the priority illumination field is projected by the middle row of lamp set while the auxiliary illumination field is projected by the lamp sets at the both sides. The light beam field projected by the lamp sets is overlapped within the illumination field of the middle row of lamp set to provided a higher brightness of the illumination field produced by the middle row of lamp set. Apparently, the outermost illumination field is not overlapped by the projection of other lamp sets. Consequently, in the effective illumination field, the brilliance of the middle illumination field is too strong, and the outer illumination field may have halation.

To overcome the foregoing shortcomings, the inventor(s) of the present invention based on years of experience in the related field, conducted extensive researches and experiments for the matrix and the lamp holder shown in prior arts, and finally invented the structure of the present invention.

BRIEF SUMMARY OF THE INVENTION

The purpose of this invention is to provide a lamp housing for a high-power LED street lamp to install LED lamp arrays to generate the optimum light distribution, so as to substantially increase the range of the effective illumination field, and improve the brightness of the effective illumination field and the light emitting uniformity of the effective illumination field.

To accomplish the foregoing purpose, the invention provides a lamp housing for a high-power LED street lamp comprising: a back wall and a plurality of side walls cooperating with the back wall to define an open bottom end and a polygonal chamber, at least four rectangular planes formed symmetrically at each side of a centerline of the back wall. Each rectangular plane is disposed on each side progressively farther from the centerline and parallel to one another, wherein a pair of corresponding rectangular planes on each side of the centerline are inclined with respect to the back wall such that a line normal to each corresponding rectangular planes intersect one another with different included angles and at different locations; and the lines normal to the two outermost rectangular planes intersect at an included angle of between 60 to 140 degrees.

Accordingly, after installing a LED lamp array module on the rectangular planes, the maximum effective illumination area can be produced from the LED lamp array modules through the two outermost rectangular planes. Further, by incorporating with mutually different vertical direction of the plurality of rectangular planes between the middle positions, the light beams emitted from each installed LED lamp array module can be overlapped and projected to the foregoing effective illumination field with respect to different interlaced optical angles to provide uniform distribution for the projection angle and improve the illumination brightness.

DETAILED DESCRIPTION OF THE INVENTION

Figure 1:
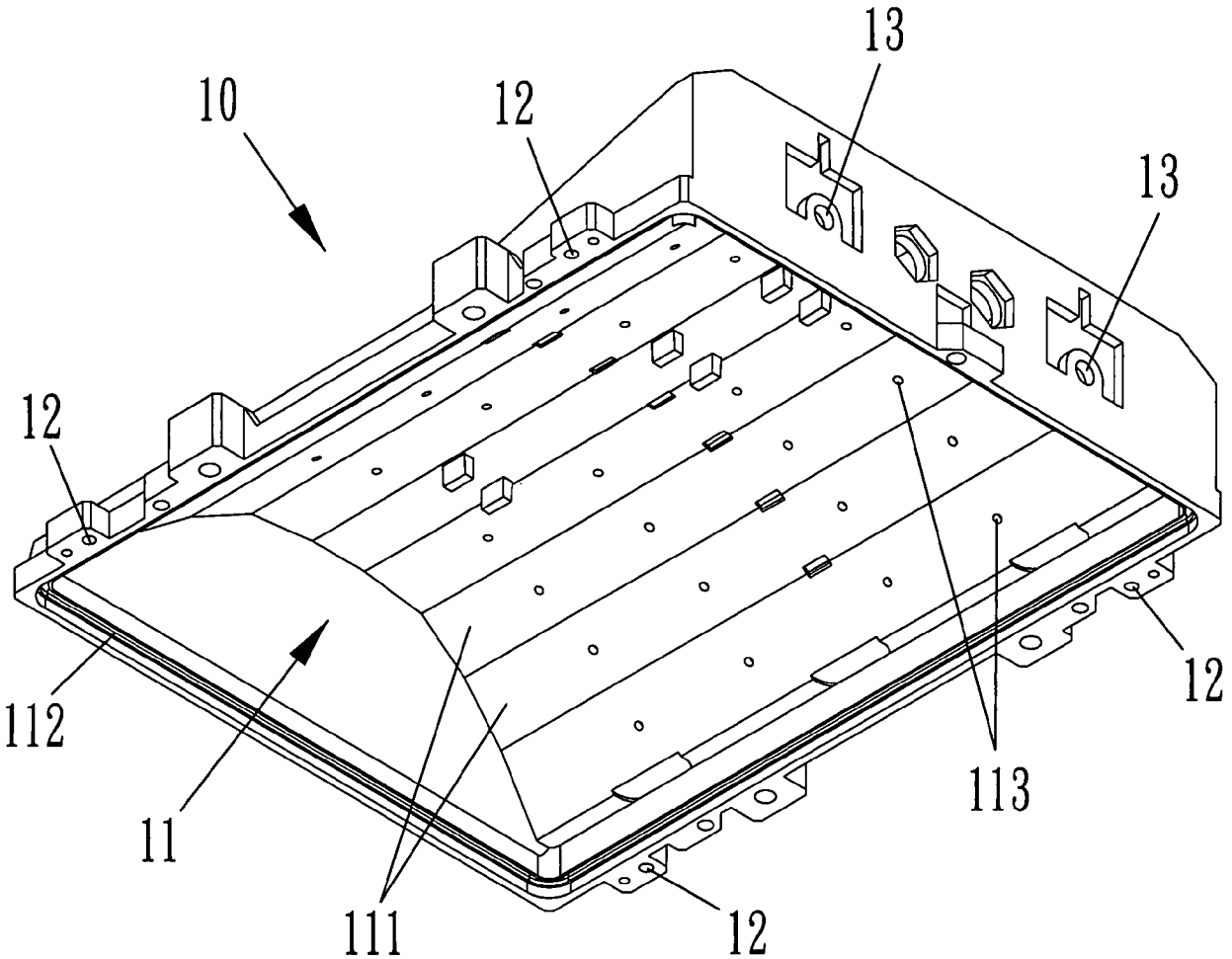
FIG. 1 is a perspective view of the preferred embodiment.
Figure 2:
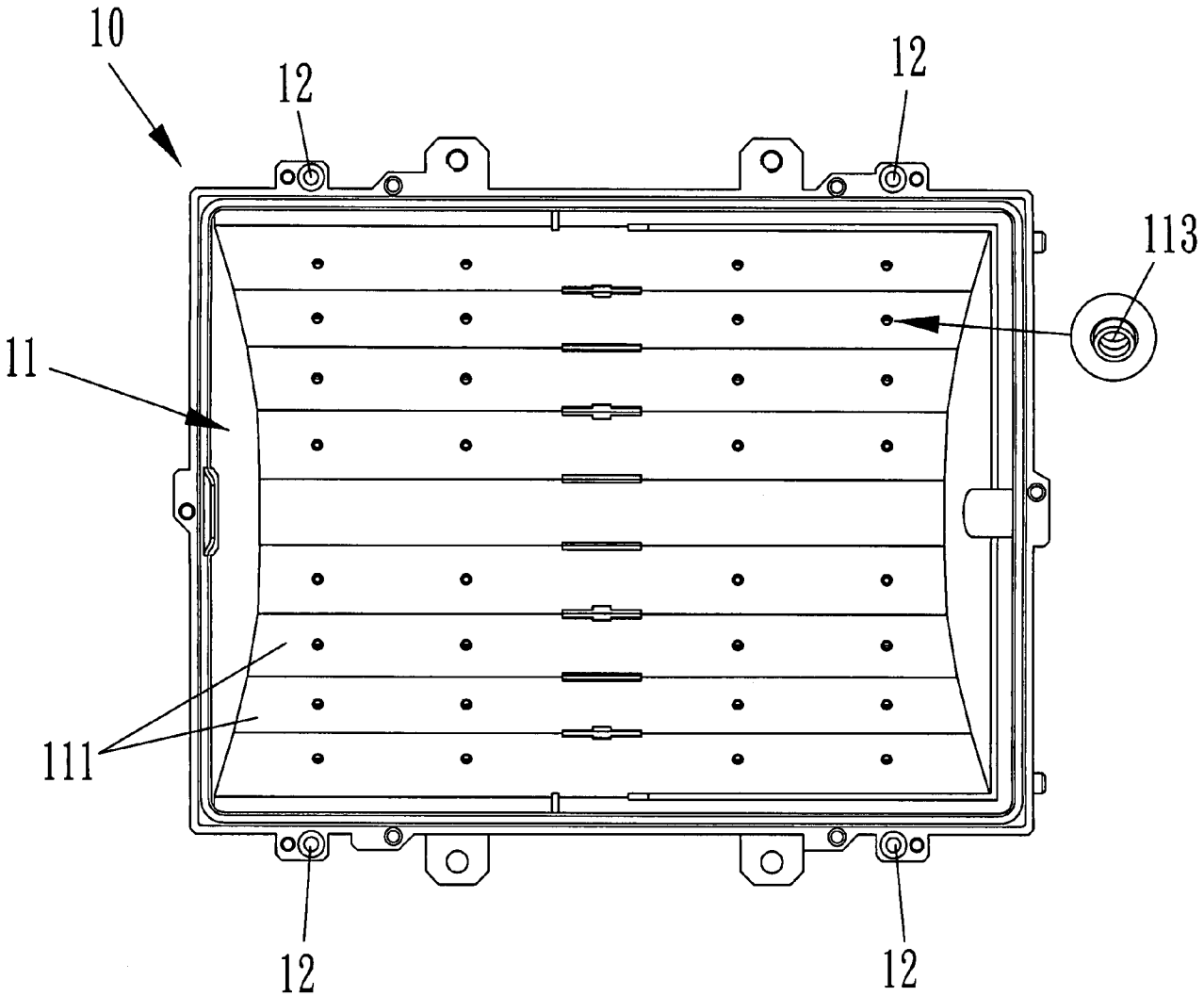
FIG. 2 is a bottom-side view of the preferred embodiment.
Figure 3:
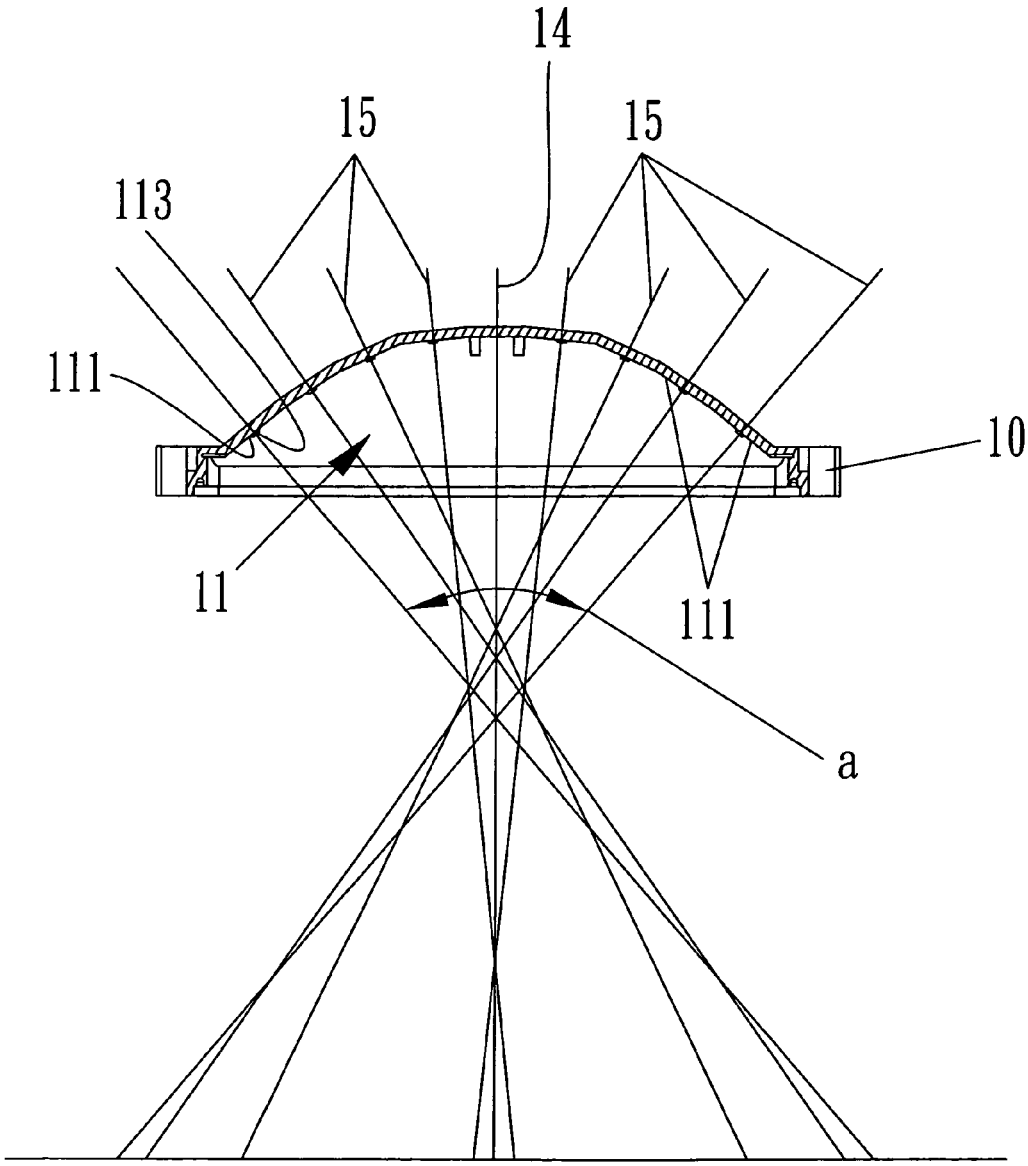
FIG. 3 is a sectional view and normal lines view of rectangular plains of the preferred embodiment.
Figure 4:
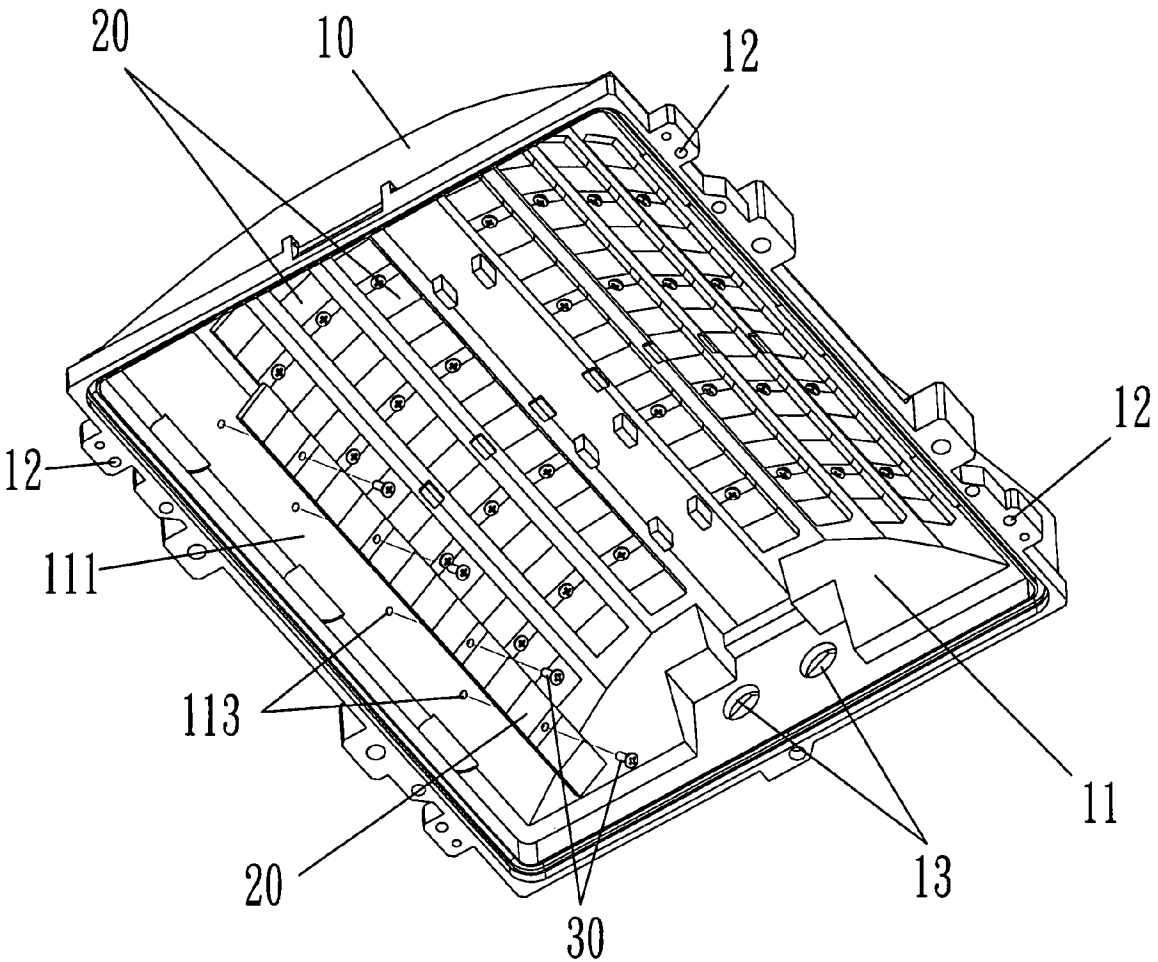
FIG. 4 is a regional exploded view of the preferred embodiment.
Figure 5:
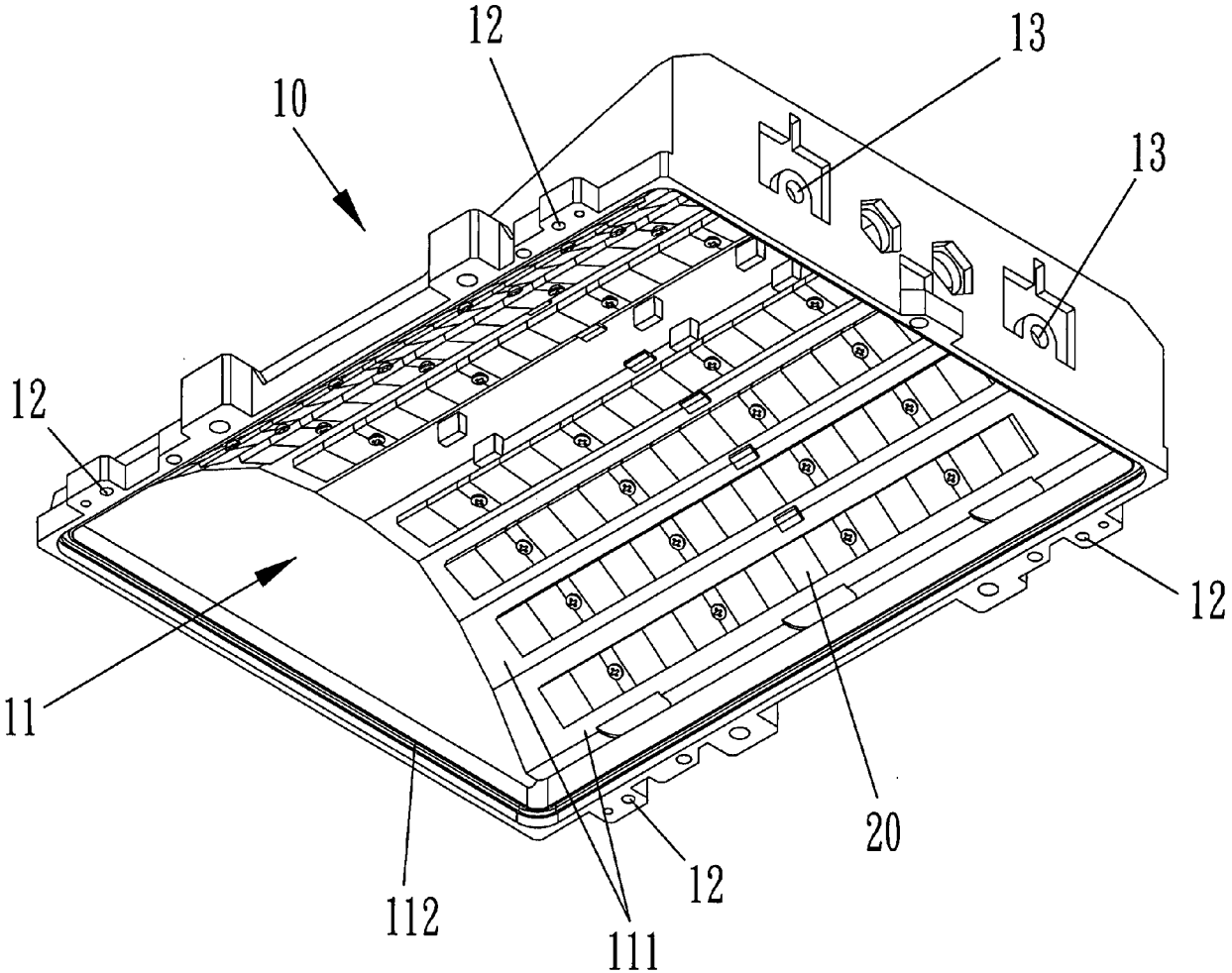
FIG. 5 is a perspective view of the FIG. 4 after assembling LED modules.
Figure 6:
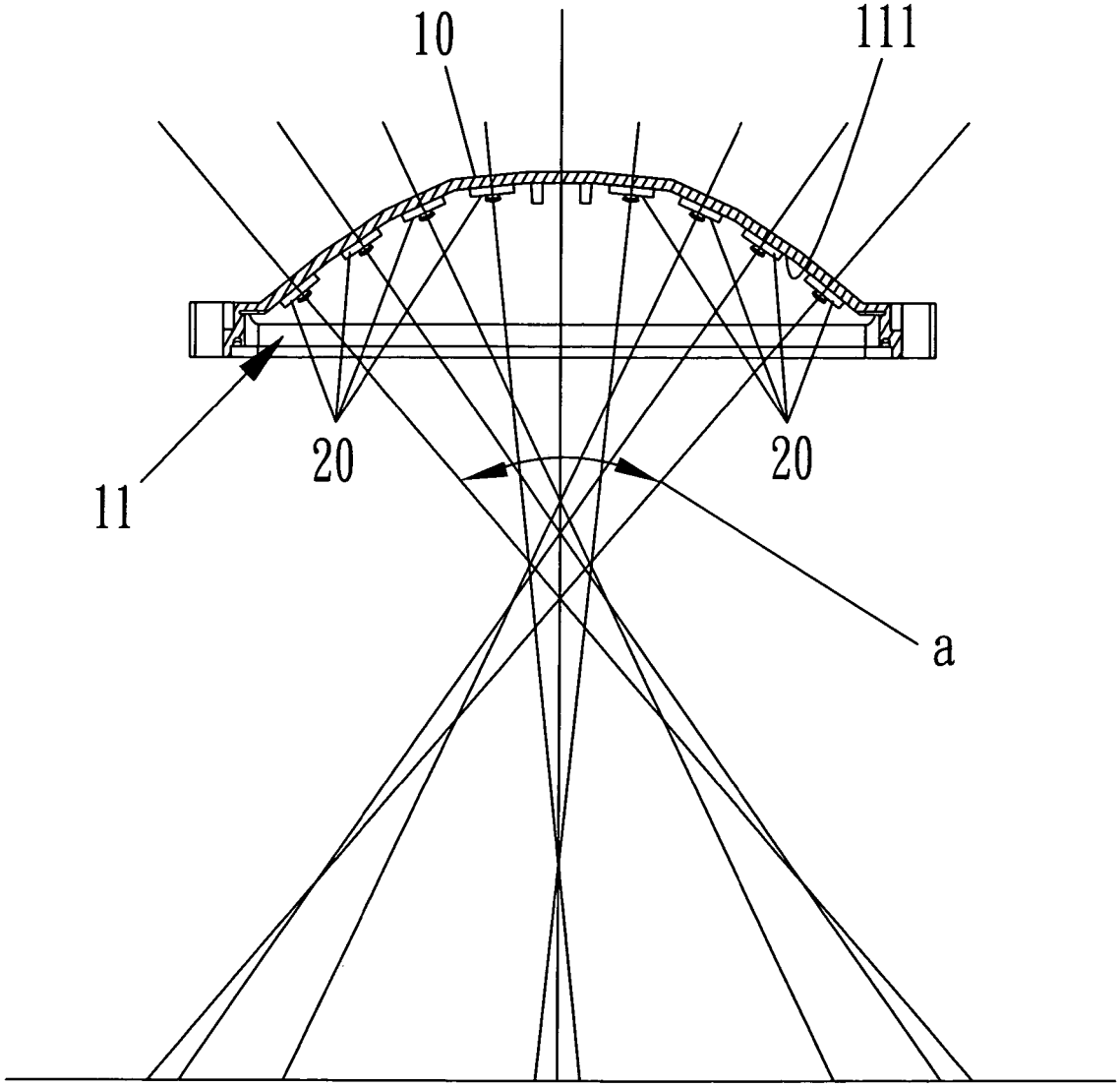
FIG. 6 is a sectional view and LED lighting angle view of the FIG. 5.

Referring to FIGS. 1-3, a lamp housing 10 for a high power LED street lamp of the present invention is shown. The lamp housing 10 comprises a back wall and a plurality of side walls cooperating with the back wall to define an open bottom end and a polygonal chamber 11 for installing a plurality of LED lamp array modules 20 (as shown in FIGS. 4-6). The polygonal chamber has at least four rectangular planes 111 formed symmetrically at each side of centerline of the back wall 11. Each rectangular plane 111 is disposed on each side progressively farther from the centerline and parallel to one another.

Figure 7:
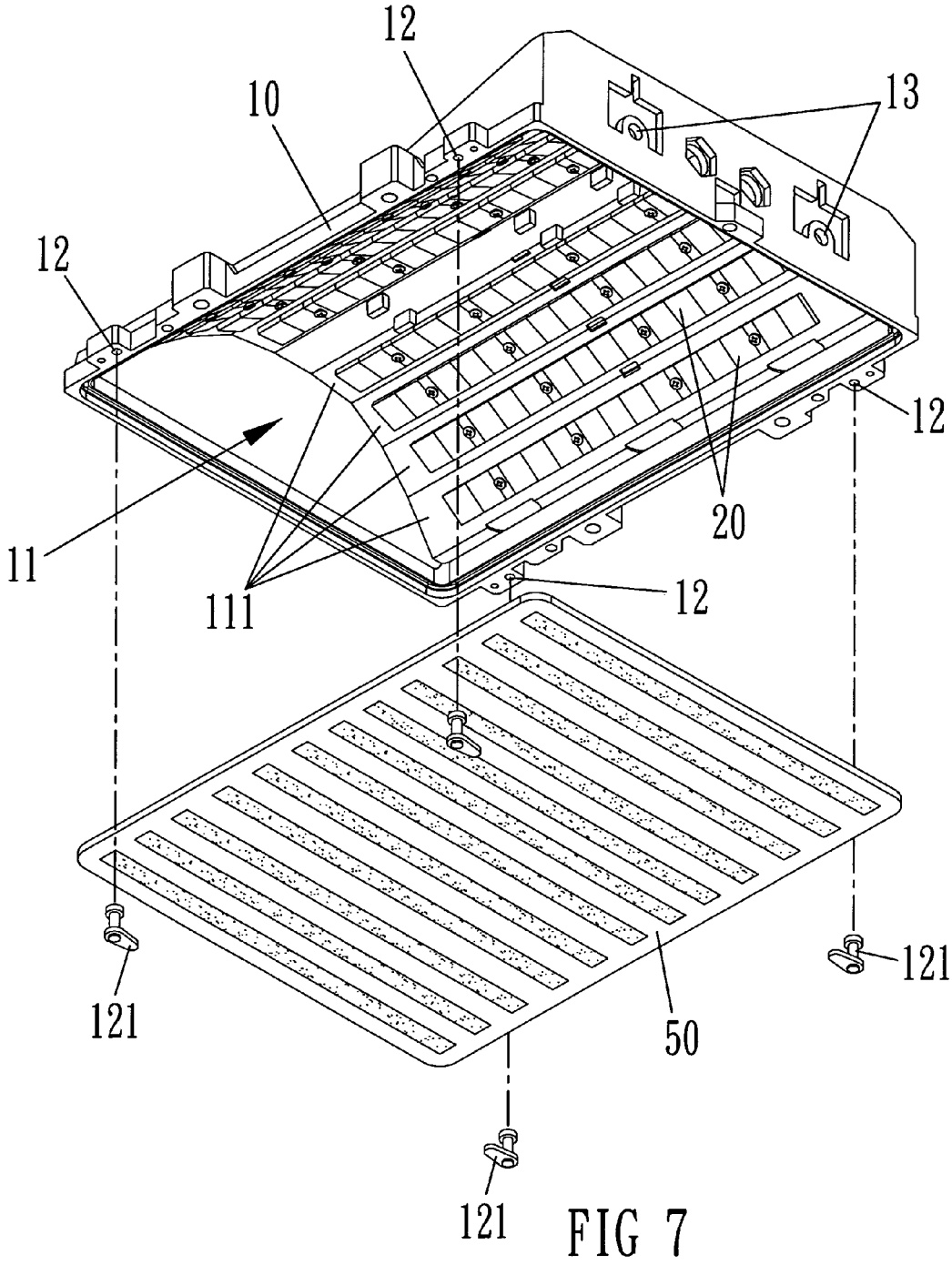
FIG. 7 is an assembly explanative view of transparent cover.
Figure 8:
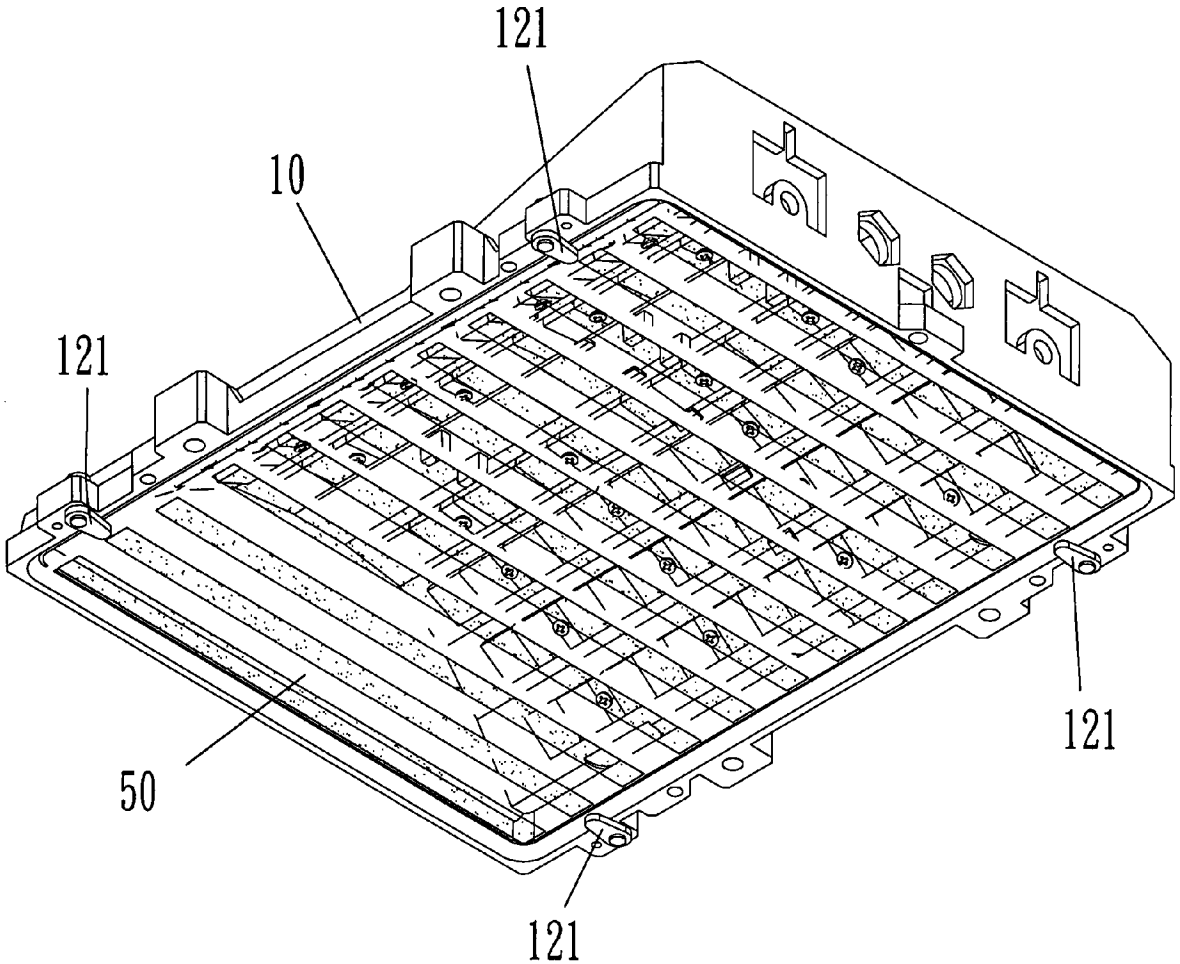
FIG. 8 is an assembled view of FIG. 7.

A rim groove 112 is formed at a bottom inner edge of the polygonal chamber 11 for embedding a rubber gasket (not shown in the figures) so that after sealing a lamp cover 50 (as shown in FIGS. 7 and 8) on the bottom inner edge, the rubber gasket can be closely in contact with the rim groove 112 through the lamp cover 50. The inside of the polygonal chamber 11 can be isolated from the outside to prevent the polygonal chamber 11 from entering rain, dew or any insect and influence the performances of other devices therein.

As shown in FIGS. 7 and 8, a plurality of symmetrical locking holes 12 are provided along the bottom peripheries of the lamp housing 10, and adjustable bolts 121 are respectively inserted into the locking holes 12 to fasten a lamp cover 50 at the open bottom end of the lamp housing 10 by turning the adjustable bolts 121. To completely seal the open bottom end, at least one through hole 13 is provided in the side walls, adjoined to the locking holes 12, for power cables (not shown in figures) to pass through.

After the high-power LED lamp array modules 20 are mounted on the plurality of rectangular planes 111 inside the polygonal chamber 11, by means of the plurality of rectangular planes 111 with optimum angle design, the high power LED lamp array modules 20 can emit lights that are mutually interlaced for projection (as shown in FIG. 3) to achieve the functions of increasing and expanding its effective illumination field. Thereby, the projection angle of light emitted by each high power LED lamp array module 20 has a uniform distribution and the illumination brightness in the effective illumination field is improved.

Moreover, each rectangular plane 111 inside the polygonal chamber 11 as shown in FIGS. 1-4 is provided with a plurality of screw holes 113 at proper positions. The high-power LED lamp array modules 20 can be stably positioned by incorporating locking components 30 locked into the screw holes 113.

The high power LED lamp array modules 20 can be a string-type, a brick-type or any type equivalent to the high power LED lamp array modules 20. The LED lamp array module 20 exemplified in this embodiment contains metal or ceramic substrate with high heat-conducting coefficient. The foregoing metal substrate can be an aluminum strip or piece, and a plurality of LED lamps is electrically connected in series so that the LED lamp array modules 20 can be easily and rapidly mounted onto the rectangular planes 111.

Further, each rectangular plane 111 contained in the polygonal chamber 11 of the lamp holder 10 of the invention is continuously illustrated. Referring to FIG. 3, a pair of corresponding rectangular planes 111 on each side of a centerline 14 are inclined with respect to the back wall such that a line normal to each corresponding rectangular planes intersect one another with different included angles and at different locations, and the lines normal to the two outermost rectangular planes intersect at an included angle of between 60 to 140 degrees to form the optimal angle. In the embodiment, the foregoing included angle is designed about 80 degrees to obtain the optimum and the widest effective illumination area after the high-power LED lamp array modules 20 are mounted on the rectangular planes 111.

Furthermore, as shown in FIG. 3, the relationship between the rectangular planes 111 in the polygonal chamber 11 and the optical angle are illustrated. The centerline 14 of the lamp housing 10 is taken as a basis in advance, and the vertical direction lines 15 of multiple sets of symmetrically rectangular planes 111 at two sides of the centerline 14 can be intersected to one another with different included angles and at different locations. Accordingly, the light source can be uniformly distributed to fully develop the light emitting efficiency so as to improve the light flux of the effective illumination field and the high uniform brightness.

Figure 9:
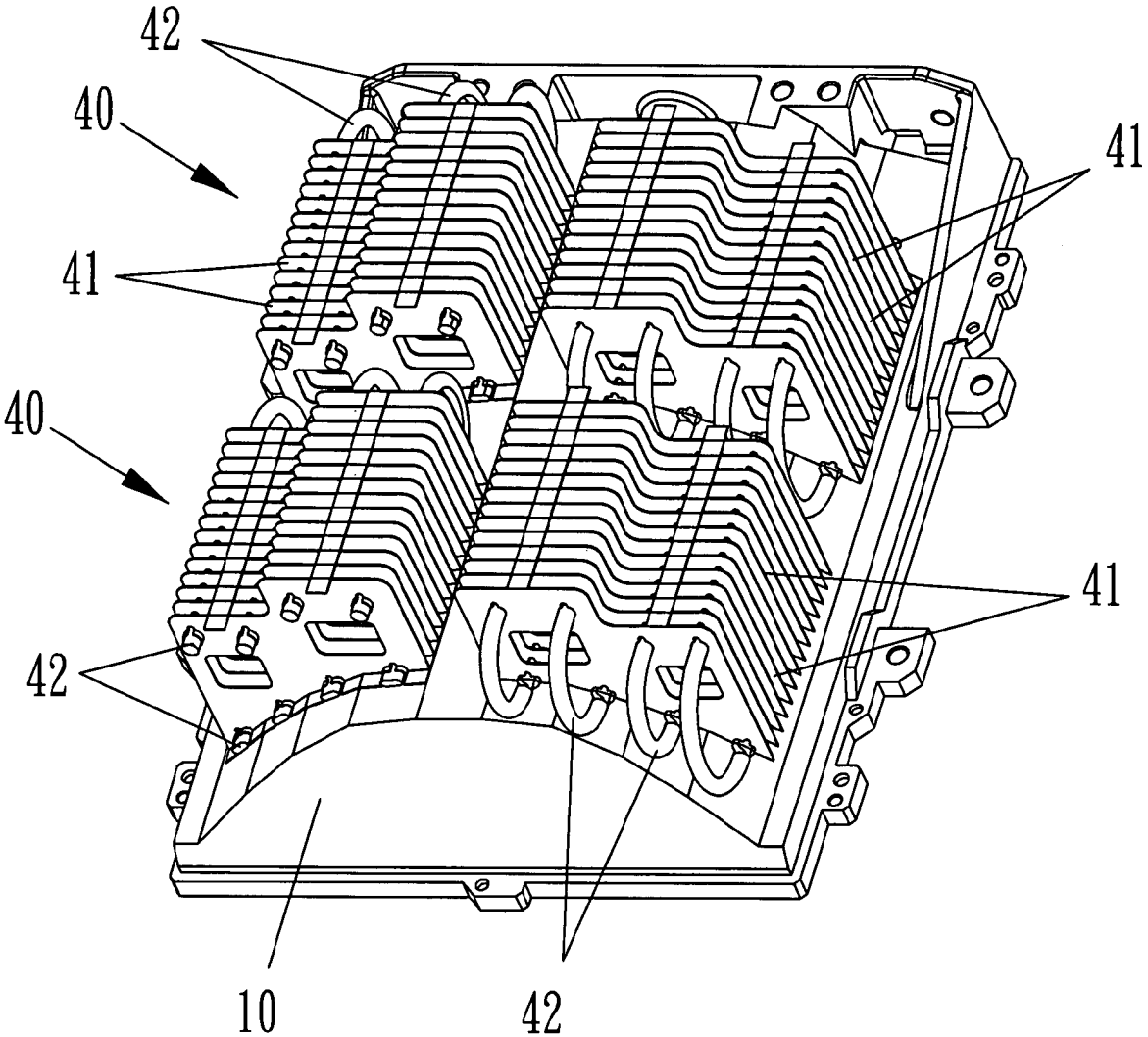
FIG. 9 is a perspective view of radiator module of the preferred embodiment.
Figure 10:
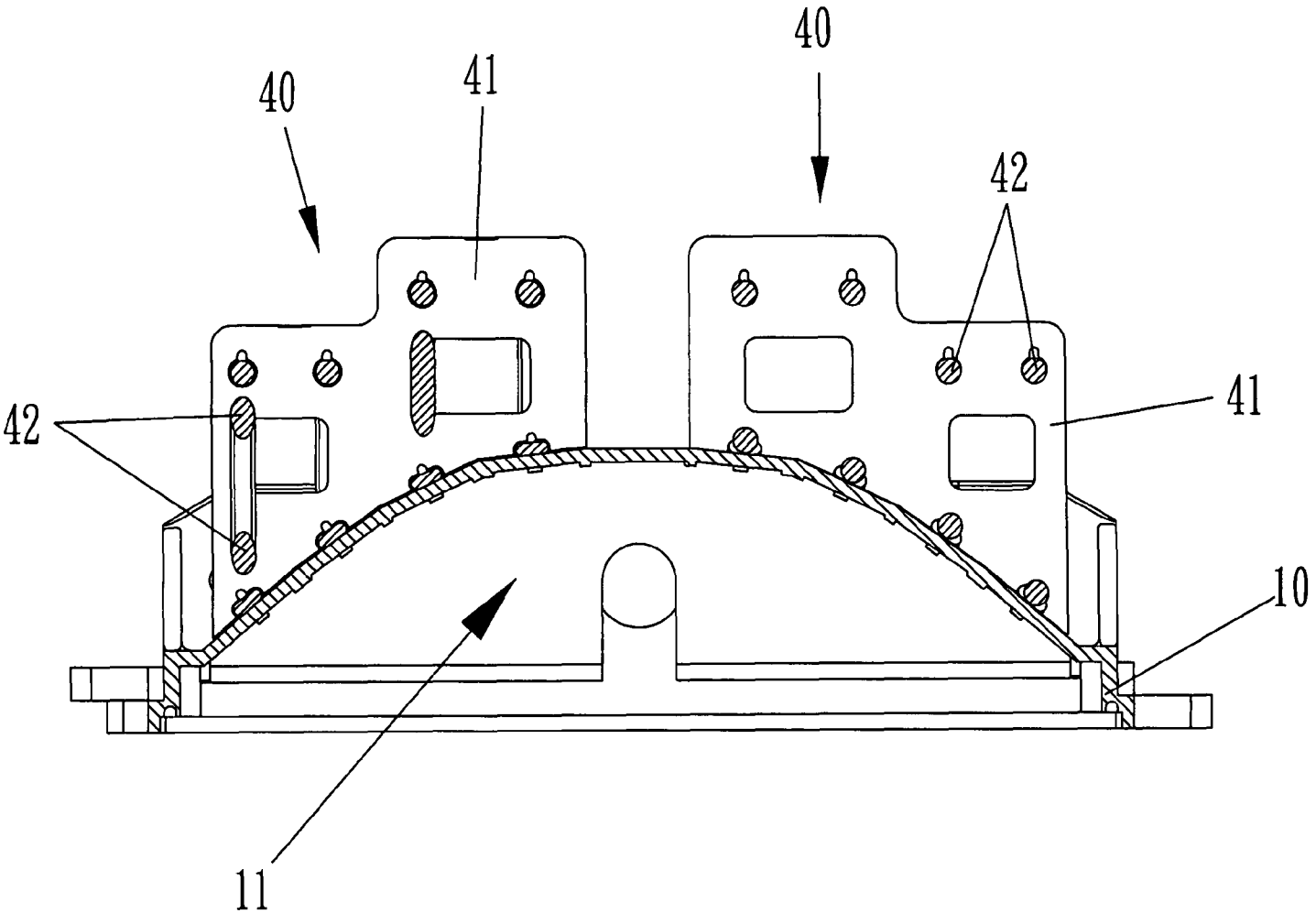
FIG. 10 is a sectional view of FIG. 7.

As shown in FIGS. 9 and 10, a heat dissipation module 40 disposed to the outside of the lamp holder 10 is arranged to overcome the component damage easily caused by concentrated heats released from the high-power LED lamp array module 20. The plurality of heat dissipation modules 40 is disposed on the outside surface of the lamp housing 10 to effectively dissipate heat generated from the high-power LED lamp array modules 20 through the heat dissipation module 40. The heat dissipation module 40 as shown in the preferred embodiment comprises a plurality of heat dissipation fins 41 spaced at equal intervals and in parallel. The heat dissipation fins 41 are connected in series by heat-conducting tubes 42 coupled to the heat dissipating fins 41 so that the heat dissipation modules 40 can be stably and absolutely mounted to the lamp housing 10. For better mounting effects, according to the embodiment, the heat dissipation module 40 is welded to the lamp housing 10 directly. However, the mounting manner between the lamp housing 10 and the heat dissipation module 40 is not merely limited to the foregoing manner. Other manner for firmly integrating the lamp housing 10 with the heat dissipation module 40 shall be still considered as equivalent techniques of the invention.

Figure 11:
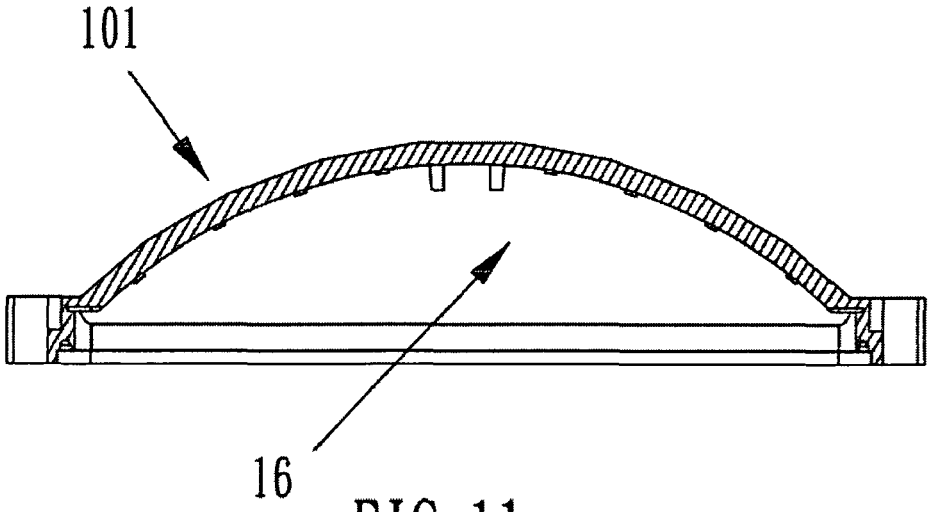
FIG. 11 is an explanative view of equivalent technique I of the concave room of the preferred embodiment.
Figure 12:
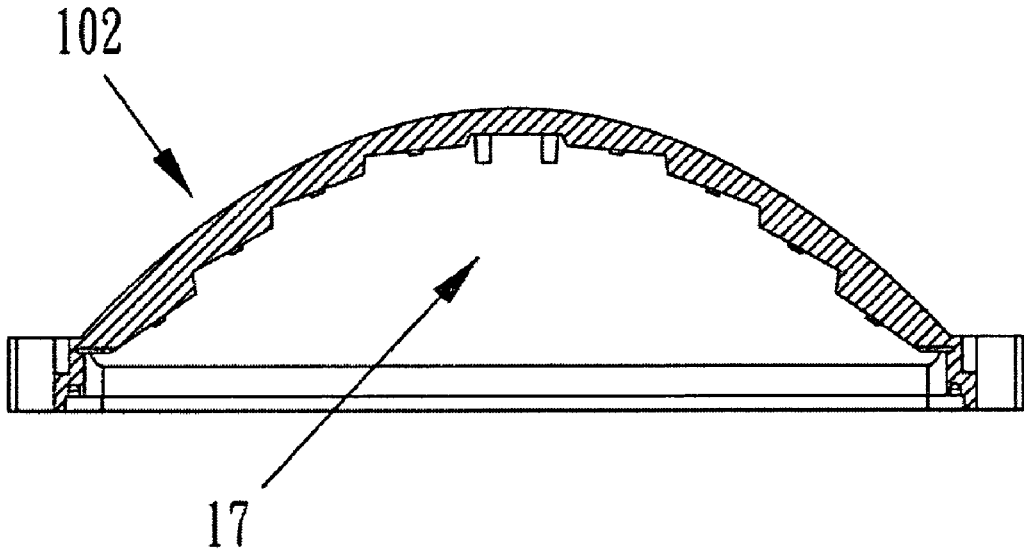
FIG. 12 is an explanative view of equivalent technique II of the concave room of the preferred embodiment
Figure 13:
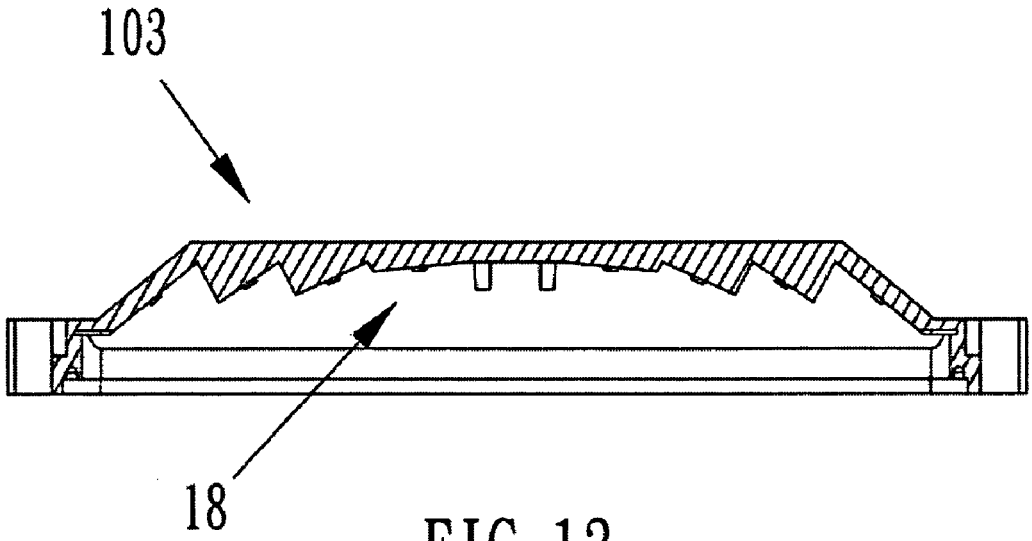
FIG. 13 is an explanative view of equivalent technique III of the concave room of the preferred embodiment

The lamp housing 10 for the high power LED street lamp of the invention mainly provides a larger illumination field and uniform distribution for the projection angle in the illumination field. Accordingly, the actual effects for improving the illumination brightness and high uniform illumination within the illumination field can be achieved. The invention not only disposes the polygonal chamber 11 in the foregoing lamp housing 10 to satisfy the purpose of the invention; but also disposes a concave chamber 16, or a stair-like chamber 17, or a continuous type pointed cone chamber 18 in the lamp housings 101, 102, 103 as shown in FIGS. 11-13, thereby replacing the foregoing polygonal chamber.

What is claimed is:

1. A lamp housing for a high-power LED street lamp comprising:

a back wall and a plurality of side walls cooperating with the back wall to define a polygonal chamber with an open bottom including a peripheral rim, wherein a plurality of symmetrical fixing holes are provided along the peripheral rim of the open bottom;

at least four rectangular planes formed symmetrically at each side of a centerline of the back wall, and each rectangular plane disposed on each side progressively farther from the centerline and longitudinally parallel to one another, wherein a pair of corresponding rectangular planes on each side of the center line are inclined with respect to the back wall such that lines normal to each corresponding pair of rectangular planes intersect one another with different included angles and at different locations, and the lines normal to the outmost pair of rectangular planes intersect at an included angle of between 60 to 140 degrees;

a lamp cover and a plurality of adjustable bolts which are respectively inserted into the fixing holes to fasten the lamp cover at the open bottom end of the lamp housing by turning the adjustable bolts; and at least one heat dissipation module disposed on an outside surface of the lamp housing, the heat dissipation module comprising:

a plurality of heat dissipation fins spaced at equal intervals and in parallel; and a plurality of heat conducting tubes coupled to the heat dissipating fins.

* * * * *